US011842716B2

(12) United States Patent
Lu et al.

(10) Patent No.: US 11,842,716 B2
(45) Date of Patent: Dec. 12, 2023

(54) GLOBAL ACTIVE NOISE CONTROL METHOD FOR ROTORCRAFT

(71) Applicant: NANJING UNIVERSITY OF AERONAUTICS AND ASTRONAUTICS, Nanjing (CN)

(72) Inventors: Yang Lu, Nanjing (CN); Xice Xu, Nanjing (CN); Mengxue Shao, Nanjing (CN); Jinru Chen, Nanjing (CN)

(73) Assignee: NANJING UNIVERSITY OF AERONAUTICS AND ASTRONUATICS, Nanjing (CN)

( * ) Notice: Subject to any disclaimer, the term of this patent is extended or adjusted under 35 U.S.C. 154(b) by 0 days.

(21) Appl. No.: 17/701,810

(22) Filed: Mar. 23, 2022

(65) Prior Publication Data

US 2022/0223132 A1 Jul. 14, 2022

(51) Int. Cl.
*G10K 11/178* (2006.01)

(52) U.S. Cl.
CPC .. *G10K 11/17823* (2018.01); *G10K 11/17873* (2018.01); *G10K 2210/1281* (2013.01); *G10K 2210/3027* (2013.01); *G10K 2210/3044* (2013.01); *G10K 2210/3055* (2013.01); *G10K 2210/30232* (2013.01)

(58) Field of Classification Search
CPC ..... G10K 11/17823; G10K 11/17873; G10K 2210/1281; G10K 2210/30232; G10K 2210/3027; G10K 2210/3044; G10K 2210/3055
USPC ..... 381/71.12
See application file for complete search history.

(56) References Cited

U.S. PATENT DOCUMENTS 4,170,142 A * 10/1979 Posakony ..... B06B 1/0622 367/105
2003/0219132 A1* 11/2003 Sommerfeldt ... G10K 11/17854 381/71.7
2016/0295342 A1* 10/2016 Miyasaka ..... H04S 7/305
2018/0190260 A1* 7/2018 Christoph ..... G10K 11/17823
2018/0204561 A1* 7/2018 Goto ..... G10K 11/17883

FOREIGN PATENT DOCUMENTS

CN 113670559 A 11/2021
CN 113793587 A 12/2021

* cited by examiner

*Primary Examiner* — Vivian C Chin
*Assistant Examiner* — Douglas J Suthers

(57) ABSTRACT

A global active noise control method for a rotorcraft, including: acquiring the acoustic pressure signal at a measuring point of the rotorcraft; predicting the holographic and global sound field of noise of the rotor; reconstructing the reverse sound field of the noise of the rotor; and performing adaptive sound field adjustment based on the optimal phase search.

10 Claims, 3 Drawing Sheets

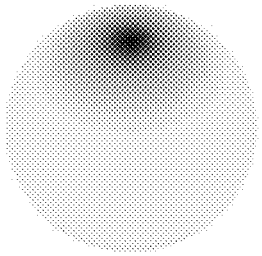
Fig. 3A
Original sound field of the rotor noise (r=0.7 m)
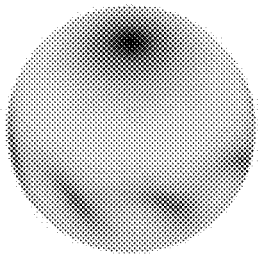
Fig. 3B
Sound field after the global noise control (r=0.7 m)
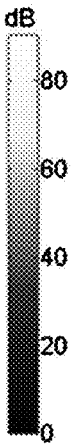
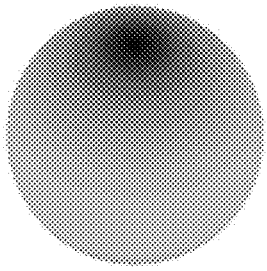
Fig. 3C
Original sound field of the rotor noise (r=1.4 m)
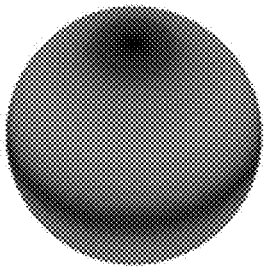
Fig. 3D
Sound field after the global noise control (r=1.4 m)
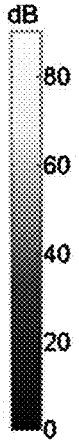

GLOBAL ACTIVE NOISE CONTROL METHOD FOR ROTORCRAFT

CROSS-REFERENCE TO RELATED APPLICATIONS

This application claims the benefit of priority from Chinese Patent Application No. 202110641950.2, field on Jun. 9, 2021. The content of the aforementioned application, including any intervening amendments thereto, is incorporated herein by reference.

TECHNICAL FIELD

This application relates to rotorcraft aerodynamic noise control, and more particularly to a global active noise control method based on acoustic holography and sound field reconstruction.

BACKGROUND

The rotorcraft is capable of lifting and landing vertically and flying at a low altitude, which makes it widely used in military and civilian fields. The rotorcraft is considered as a promising transportation vehicle for the future urban air traffic. The rotorcraft will be possibly applied to battlefield delivery, aerial photography and geophysical prospecting, passenger transportation service (such as air taxis), emergency ambulance, freight services, smart city management and air media. Unfortunately, the aerodynamic noise generated from the interaction between the rotor of the rotorcraft and air will not only seriously affect the military concealment and detectability of the rotorcraft, but also cause great environmental noise pollution and interference. The application of the rotorcraft will be greatly limited by the aerodynamic noise radiated by the rotor. Hence, it is of great scientific significance and application value to explore an effective noise control method for rotorcrafts.

Currently, the rotor aerodynamic noise is mainly controlled by passive noise reduction and active noise reduction. The passive noise reduction involves the optimization of rotor structure, such as blade shape optimization (i.e., airfoil distribution adjustment, blade tip sweepback, and blade taper). However, the passive noise reduction is accompanied by a decline in the output power and thrust of the rotor, which will weaken the aerodynamic performance of the rotor. Moreover, the passive noise reduction method usually suffers problems of adaptability to flight conditions. At present, the theoretical researches and experiments of the active noise control mainly focus on the control of blade-vortex interference noise, including higher harmonic control, individual blade control, active twist rotor, and active control flap. However, the active noise control method requires the introduction of complex mechanical structures or external excitations to the existing rotor system, which will further increase the complexity of the rotor system and affect the reliability and safety of the rotor.

In general, the practicability and feasibility of the existing active rotor noise control methods are not satisfactory, failing to effectively suppress the rotor aerodynamic noise.

SUMMARY

An object of this disclosure is to provide a global active noise control method, which can realize an adaptive and effective control of the global noise of the rotor.

The technical solutions of the disclosure are described below.

The disclosure provides a global active noise control method for a rotorcraft, comprising:

- measuring, by an acoustic measuring device array arranged on the rotorcraft, noise of the rotorcraft;
- inputting a noise pressure signal of the rotorcraft to acquire an acoustic mode expansion form of a global rotor noise by using an acoustic analysis method;
- online estimating optimal acoustic modal coefficients based on acoustic holography by using a measurement signal of the acoustic measuring device array to obtain an acoustic holographic global sound field of the rotor;
- based on the acoustic holographic global sound field, online generating a secondary sound field that just achieves global sound-sound cancellation with the rotor noise according to a sound field construction method by using a secondary acoustic source array;
- inputting the optimal acoustic modal coefficients to online calculate a real-time control signal of the secondary acoustic source array according to an acoustic modal orthogonal relationship; and
- online adjusting the real-time control signal of the secondary acoustic source array by using an adaptive method to realize global noise reduction of the rotor under different flight conditions.

In some embodiments, the acoustic mode expansion form of the global rotor noise is obtained through steps of:

- for an aerodynamic noise of the rotor, a tip speed of which is less than speed of sound, setting the Ffowcs-Williams Hawking acoustic analogy equation as equation (1), wherein noise outside a rotor rotation area satisfies a passive homogeneous wave equation (2); and introducing a Fourier transform for derivation; shown as follows:

$$\nabla^2 p - \frac{1}{c^2}\frac{\partial^2 p}{\partial t^2} = -\frac{\partial}{\partial t}[\rho_0 v_n|\nabla f|\delta(f)] + \frac{\partial}{\partial x_i}[l_i|\nabla f|\delta(f)] - \frac{\partial}{\partial x_i \partial x_j}[T_{ij}H(f)]; \tag{1}$$

and $$\nabla^2 p - \frac{1}{c^2}\frac{\partial^2 p}{\partial t^2} = 0; \tag{2}$$

wherein p is a sound pressure; c is the speed of sound; $v_n$ is a normal velocity of a blade surface; $\rho_0$ is air density; $l_i$ is a load per unit area of a medium; f (x,t)=0 is a boundary of the blade surface; δ(f) indicates that thickness and load noise sources are only distributed on the blade surface, and are surface sound sources; r, θ, ϕ respectively represent a distance from an observation point to an origin, an elevation angle, and an azimuth angle; ω is a noise frequency; and k□ω/c represents a wave number;

- expressing an arrangement position of an acoustic measuring device in a spherical coordinate system as equation (3), wherein a frequency domain form of an acoustic wave equation of the spherical coordinate system is expressed by equation (4); shown as follows:

$$r_j = (r_j, \theta_j, \phi_j), \tag{3}$$

-continued $$j = 1 \cdots J;$$

and $$\nabla^2 p + k^2 p = 0; \tag{4}$$

based on a Fourier acoustic analysis method, a series expansion form of a rotor noise solution that meets Sommerfeld radiation condition is expressed as equation (5):

$$p^d(r, \theta, \phi, k) = \sum_{n=0}^{\infty} h_n^{(1)}(kr) \sum_{m=-n}^{n} C_{m,n}(k) Y_n^m(\theta, \phi); \tag{5}$$

wherein $C_{m,n}(k)$ is an acoustic modal coefficient; $h_n^{(1)}(kr)$ represents a first-order Spherical Hankel function; and $Y_n^m(\theta,\phi)$ represents a spherical harmonics function.

In some embodiments, the optimal acoustic modal coefficients are estimated online through steps of:

in a specified basis function $\Psi_{n,m}^{(1)}$, performing an optimal approximation on a noise pressure signal of a measuring point to estimate the optimal acoustic modal coefficients, wherein the acoustic modal coefficient and the noise pressure signal of the measuring point of the acoustic measuring device array meet the following equations:

$$\{p^d(r_j, \theta_j, \phi_j, k)\}_{J\times 1} = \left[\Psi^{(1)}(r_j, \theta_j, \phi_j, k)\right]_{J\times((N'+1)^2)} \{C_{m,n}(k)\}_{((N'+1)^2)\times 1}; \tag{6}$$

and $$\Psi_{n,m}^{(1)}(r_j, \theta_j, \phi_j, k) \equiv h_n^{(1)}(kr_j) Y_n^m(\theta_j, \phi_j); \tag{7}$$

and solving the optimal acoustic modal coefficients by using a regularization method, expressed as:

$$\{C_{m,n}(k)\} = \left(\left[\Psi^{(1)}\right]^H \left[\Psi^{(1)}\right]\right)^{-1} \left[\Psi^{(1)}\right]^H \{p^d\}. \tag{8}$$

In some embodiments, the secondary sound field is generated online through steps of:

expressing an arrangement position of the secondary acoustic source array in the spherical coordinate system as $r_s=(r_s,\theta_s,\phi_s)$, s=1 . . . S, wherein a sound field generated by the secondary acoustic source array is expressed as equation (9); and a reconstructed target sound field meets equation (10); shown as follows:

$$p^S(r, \theta, \phi, k) = \sum_{s=1}^{S} p^s(r, \theta, \phi, k) \; |r| \geq \max_{1\leq s\leq S} |r_s| = \sum_{n=0}^{\infty} h_n^{(1)}(kr) \sum_{m=-n}^{n} ik \left( \sum_{s=1}^{S} Q_s j_n(kr_s) Y_n^m(\theta_s, \phi_s)^* \right) Y_n^m(\theta, \phi); \tag{9}$$

and $$p^S(r, \theta, \phi, k) = -p^d(r, \theta, \phi, k) = \sum_{n=0}^{\infty} h_n^{(1)}(kr) \sum_{m=-n}^{n} -C_{m,n}(k) Y_n^m(\theta, \phi); \tag{10}$$

wherein $Q_s$ a mass-source intensity of a secondary acoustic source, and $Q_s=-i\omega\rho_0 q_s$; and $q_s$ is a volume-source intensity of the secondary acoustic source.

In some embodiments, the real-time control signal of the secondary acoustic source array is calculated online through steps of:

according to equation (9) and equation (10) and based on an orthogonality of the acoustic modal coefficient, adjusting the real-time control signal of the secondary acoustic source array until a source intensity meets equation (11) to generate a reverse sound field of a rotor noise, wherein matrix parameters in the equation (11) are expressed by equations (12)-(15):

$$ikJTQ = -C; \tag{11}$$

$$Q = [\, Q_1 \;\; \cdots \;\; Q_S \,]^T_{S\times 1}; \tag{12}$$

$$T = \{Y_n^m(\theta_s, \phi_s)^*\}_{(N'+1)^2\times S}; \tag{13}$$

$$J = \{j_n(kr_s)\}_{(N'+1)^2\times(N'+1)^2}; \tag{14}$$

and $$C = \{C_{m,n}(k)\}_{(N'+1)^2\times 1}; \tag{15}$$

wherein matrix Q represents a sound source intensity of each unit of the secondary acoustic source array; matrix T indicates that an independent vector set of an acoustic modal space generated by the secondary acoustic source array is determined by an azimuth angle $\phi_s$ and an elevation angle $\theta_s$ of the secondary acoustic source array;

characteristics of the sound field generated by the secondary acoustic source array are determined by a radius $r_s$ of the secondary acoustic source array, and are reflected in low-pass characteristics of a function $j_n(kr_s)$ of a diagonal matrix J with respect to order n; matrix T is not a square matrix; the real-time control signal of the secondary acoustic source array is calculated by regularization.

In some embodiments, the sound field construction method is selected from a high-order ambient stereo method, a wave field synthesis method, a spherical harmonic decomposition method, or a combination thereof.

In some embodiments, the adaptive method is an exponential phase online search method.

In some embodiments, during reconstruction of a reverse sound field of the rotor, when a phase change caused by a speed fluctuation or flight condition of the rotor exceeds a threshold, the adaptive method is used to update a phase and adjust the real-time control signal of the secondary acoustic source array online to realize adaptive reconstruction of the reverse sound field.

In some embodiments, the acoustic measuring device array and the secondary acoustic source array are arranged in the rotorcraft; the acoustic measuring device array is configured to collect a noise pressure signal data at a measuring point; and the secondary acoustic source array is configured to online generate the secondary sound field that offsets the global noise of the rotor.

Compared to the prior art, the present disclosure has the following beneficial effects.

With respect to the global active noise control method provided herein, an acoustic measuring device array is arranged on the rotorcraft to collect the acoustic pressure signal data of the noise, and an online prediction model of the rotor noise sound field is established based on acoustic holography. Moreover, based on the sound field reconstruction, a reverse sound field of the global noise sound field of the rotor is reconstructed using the secondary acoustic source array. By superimposing the reverse sound field with the original noise field of the rotor, the global noise reduction of the rotor can be achieved through sound-sound cancellation.

Compared with the existing passive and active noise reduction methods, the global active noise control method based on acoustic holography and sound field reconstruction provided herein does not need to change the rotor airfoil or introduce complex mechanical structures, and only need to arrange several measuring devices and secondary acoustics sources around the rotorcraft, avoiding the increase of system complexity and cost, and allowing for higher practical value and superior noise reduction effects.

Compared with the traditional multi-channel noise control at limited points of the rotor based on the adaptive filtering algorithm, the global active noise control method based on acoustic holography and sound field reconstruction provided herein is more consistent, and can achieve the global noise reduction of the rotor.

In addition, the adaptive sound field adjustment based on the optimal phase search can overcome the adverse effects of the rotation speed fluctuation on the noise reduction performance, and realize the online update of the reversely reconstructed sound field and the adaptive control of the global noise reduction of the rotor.

BRIEF DESCRIPTION OF THE DRAWINGS

FIGS. 3A-3D schematically shows spherical acoustic pressure distributions before and after the global noise reduction according to an embodiment of the present disclosure, where 3A: original sound field of the rotor noise (r=0.7 m); 3B: sound field after the global noise control (r=0.7 m); 3C: original sound field of the rotor noise (r=1.4 m); and 3D: sound field after the global noise control (r=1.4 m).

DETAILED DESCRIPTION OF EMBODIMENTS

The technical solutions of the present disclosure will be clearly and completely described below with reference to the accompanying drawings and embodiments. Obviously, the described embodiments are only illustrative, and are not intended to limit the disclosure. Based on the embodiments of the present disclosure, all other embodiments obtained by those skilled in the art without paying creative efforts shall fall within the scope of the present disclosure.

Figure 1:
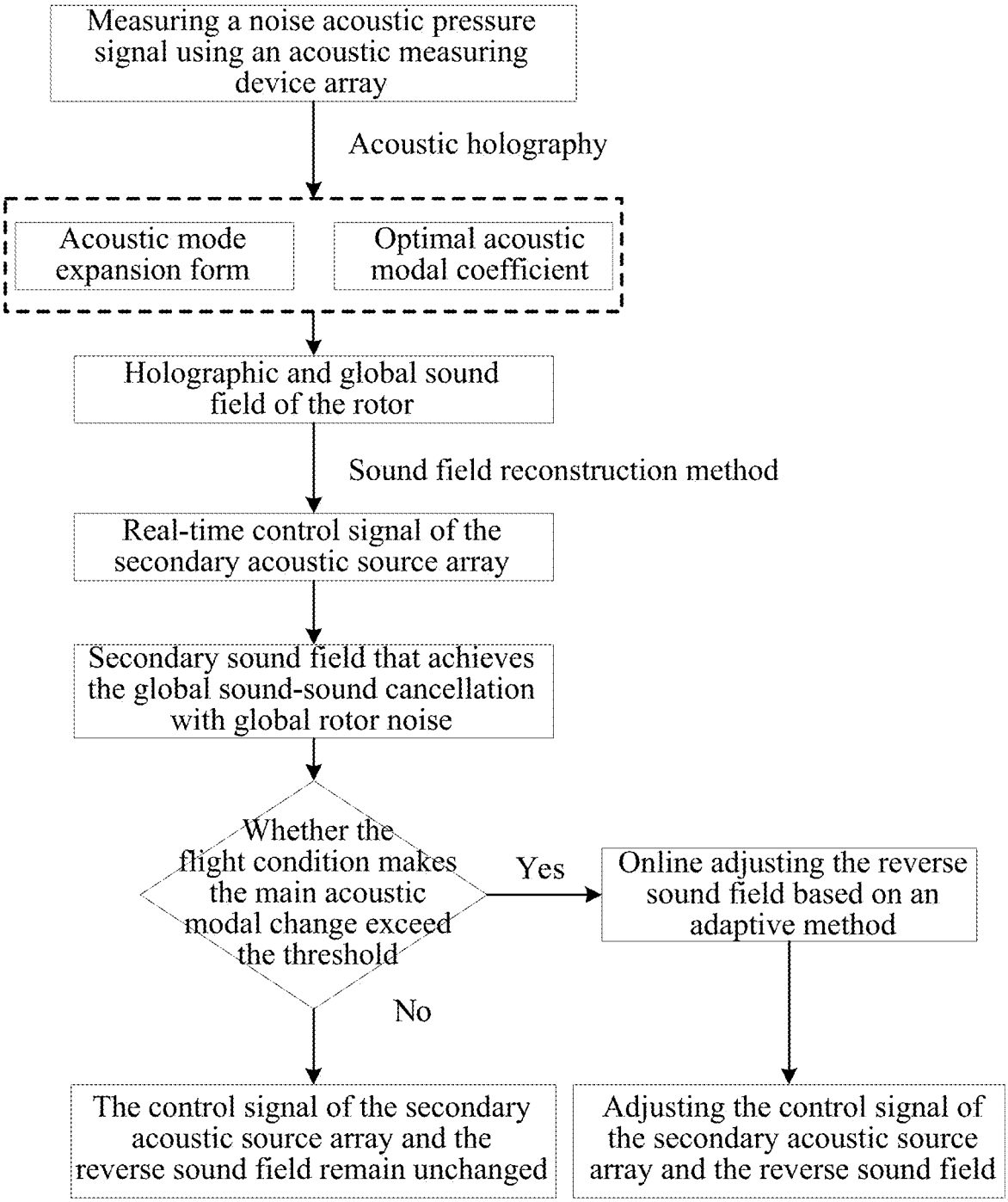
FIG. 1 is a flow chart of a global active noise control method for a rotorcraft according to an embodiment of the present disclosure.

Referring to FIG. 1, provided is a global active noise control method based on acoustic holography and sound field reconstruction, which includes the acoustic pressure signal acquisition of noise at a measuring point by means of an acoustic measuring device array on the rotorcraft, the holographic and global sound field calculation of the rotor, the generation of a sound field that offsets the global noise of the rotor, and the online sound field adjustment based on an adaptive method. The global active noise control method specifically includes the following steps.

(S1) Noise Acoustic Pressure Signals Acquisition

Measuring points, the acoustic measuring device array, and the secondary acoustic source array are arranged on the rotorcraft based on the analysis of the shape and basic structure of the rotorcraft. The acoustic measuring device array is configured to collect an acoustic pressure signal data of noise at a measuring point. The secondary acoustic source array is configured to online generate the secondary sound field that offsets the global noise of the rotor.

The common sampling forms of the acoustic measuring device array and the secondary acoustic source array outside the rotating region include but are not limited to uniform sampling, Gaussian sampling, approximately uniform sampling, etc.

(S2) Holographic and Global Sound Field Calculation

An acoustic pressure signal of the noise of the rotorcraft is inputted to acquire an acoustic mode expansion form of a global noise of a rotor by using an acoustic analysis method. Then a measurement signal of the acoustic measuring device array is used to online estimate an optimal acoustic modal coefficient based on an acoustic holography method to obtain an acoustic holographic global sound field of the rotor.

For the aerodynamic noise of the rotor, the Ffowcs-Williams Hawking acoustic analogy equation is equation (1). As the Dirichlet function δ(f) is only meaningful on the object plane, the sound source term on the right side of equation (1) only appears in the bounded rotor rotation area. When noise outside a rotor rotation area satisfies a passive homogeneous wave equation (2), a Fourier transform is introduced for derivation, shown as follows:

$$\nabla^2 p - \frac{1}{c^2}\frac{\partial^2 p}{\partial t^2} = -\frac{\partial}{\partial t}[\rho_0 v_n|\nabla f|\delta(f)] + \frac{\partial}{\partial x_i}[l_i|\nabla f|\delta(f)] - \frac{\partial^2}{\partial x_i \psi x_j}[T_{ij}H(f)]; \tag{1}$$

and $$\nabla^2 p - \frac{1}{c^2}\frac{\partial^2 p}{\partial t^2} = 0; \tag{2}$$

where p is a sound pressure; c is the speed of sound; $v_n$ is a normal velocity of a surface of a blade; $\rho_0$ is an air density; $l_i$ is a load per unit area of a medium; f(x,t)=0 represents a surface motion equation; δ(f) indicates that thickness and load noise sources are only distributed on the surface of the blade, and are surface sound sources; r,θ,ϕ respectively represent a distance from an observation point to an origin, an elevation angle, and an azimuth angle; ω is a noise frequency; and k□ω/c represents a wave number.

In a spherical coordinate system, an arrangement position of the acoustic measuring device array is expressed as equation (3), and a frequency domain form of an acoustic wave equation of the spherical coordinate system is expressed by equation (4), shown as follows:

$$r_j = (r_j, \theta_j, \phi_j), \quad j = 1 \cdots J; \tag{3}$$

and $$\nabla^2 p + k^2 p = 0; \tag{4}$$

In addition, the sound field solution represented by equation (2) should also satisfy the two boundary conditions (Somerfield radiation condition), namely, the sound pressure is continuous at the measurement point and the rotor noise sound pressure approaches 0 at infinity. Then based on a Fourier acoustic analysis method, a series expansion form of a rotor noise solution that meets a Sommerfeld radiation condition is expressed as equation (5):

$$p^d(r, \theta, \phi, k) = \sum_{n=0}^{\infty} h_n^{(1)}(kr) \sum_{m=-n}^{n} C_{m,n}(k) Y_n^m(\theta, \phi); \tag{5}$$

where $C_{m,n}(k)$ is an acoustic modal coefficient, which is merely related to the acoustic mode order and wavenumber; the acoustic mode distribution of the rotor noise is closely related to the number of rotor blades; $h_n^{(1)}(kr)$ represents a first-order Spherical Hankel function, which describes the changing law of the acoustic mode in the radius; and $Y_n^m(\theta,\phi)$ represents a spherical harmonics function, which can describe the changing law of the acoustic mode in the azimuth and elevation.

Moreover, considering that there are unavoidable errors in the installation of the acoustic measuring device array, which will affect the measurement signal of the noise of the rotor. The commonly used method of calculating the acoustic mode based on the weighting coefficient does not consider the effect of those errors. The HELS method (expressed by equation (6)) developed by S. F. Wu et al. is employed, through which an optimal approximation is performed on an acoustic pressure signal of noise of a measuring point in a specified basis function $\Psi_{n,m}^{(1)}$ to estimate the optimal acoustic modal coefficient, where the acoustic modal coefficient and the acoustic pressure signal of the measuring point of the acoustic measuring device array meet the following equations:

$$\{p^d(r_j, \theta_j, \phi_j, k)\}_{J\times 1} = \left[\Psi^{(1)}(r_j, \theta_j, \phi_j, k)\right]_{J\times((N'+1)^2)} \{C_{m,n}(k)\}_{((N'+1)^2)\times 1}; \tag{6}$$

and $$\Psi_{n,m}^{(1)}(r_j, \theta_j, \phi_j, k) \equiv h_n^{(1)}(kr_j) Y_n^m(\theta_j, \phi_j). \tag{7}$$

Since the number of measurement points is generally more than the truncation term, the optimal acoustic modal coefficient can be solved by using a regularization method, expressed as:

$$\{C_{m,n}(k)\} = \left(\left[\Psi^{(1)}\right]^H \left[\Psi^{(1)}\right]\right)^{-1} \left[\Psi^{(1)}\right]^H \{p^d\}. \tag{8}$$

(S3) Generation of a Sound Field that Offsets the Global Noise of the Rotor

Based on the holographic and global sound field obtained in step (S2), the target sound field to be reconstructed is analyzed according to a sound field construction method (i.e., high-order ambient stereo, wave field synthesis, and spherical harmonic decomposition) by using a secondary acoustic source array. Based on this, the control signal of the monopole sound source group is extracted based on the acoustic modal orthogonal relationship and the matching relationship between sound fields.

In an embodiment, the monopole sound source group is generated by the secondary acoustic source array, and the high-order ambient stereo method is used to realize the reverse sound field reconstruction. This method can be unified with the Helmholtz equation least square method in step (S2) to facilitate modeling calculations. First, an arrangement position of the secondary acoustic source array is denoted as $r_s=(r_s,\theta_s,\phi_s)$, s=1 . . . S. Further, a sound field generated by the secondary acoustic source array is expressed as equation (9), which indicates that the acoustic modal coefficient generated by the secondary acoustic source array is uniquely determined by the source intensity of the secondary acoustic source array. Through adjusting the control signal of the secondary acoustic source array, any target sound fields can be generated, and the target sound field reconstructed based on acoustic cancellation is the reverse sound field of the rotor noise to achieve global noise reduction. Therefore, the reconstructed target sound field meets equation (10), shown as follows:

$$p^S(r, \theta, \phi, k) = \sum_{s=1}^{S} p^s(r, \theta, \phi, k) \ |r| \geq \max_{1\leq s\leq S} |r_s| = \sum_{n=0}^{\infty} h_n^{(1)}(kr) \sum_{m=-n}^{n} ik\left(\sum_{s=1}^{S} Q_s j_n(kr_s) Y_n^m(\theta_s, \phi_s)^*\right) Y_n^m(\theta, \phi); \tag{9}$$

and $$p^S(r, \theta, \phi, k) = -p^d(r, \theta, \phi, k) = \sum_{n=0}^{\infty} h_n^{(1)}(kr) \sum_{m=-n}^{n} -C_{m,n}(k) Y_n^m(\theta, \phi); \tag{10}$$

where $Q_s$ is a mass-source intensity of the secondary acoustic source array; and $Q_s=-i\omega\rho_0 q_s$, and $q_s$ are a volume-source intensity of the secondary acoustic source array.

according to equation (9) and equation (10) and based on an orthogonality of the acoustic modal coefficient, adjusting the real-time control signal of the secondary acoustic source array until a source intensity meets equation (11) to generate a reverse sound field of a rotor noise, wherein matrix parameters in the equation (11) are expressed by equations (12)-(15):

$$ikJTQ = -C; \tag{11}$$

$$Q = [\,Q_1 \ \cdots \ Q_S\,]^T{}_{S\times 1}; \tag{12}$$

$$T = \{Y_n^m(\theta_s, \phi_s)^*\}_{(N'+1)^2\times S}; \tag{13}$$

$$J = \{j_n(kr_s)\}_{(N'+1)^2\times(N'+1)^2}; \tag{14}$$

and $$C = \{C_{m,n}(k)\}_{(N'+1)^2\times 1}; \tag{15}$$

where matrix Q represents a sound source intensity of each unit of the secondary acoustic source array; matrix T indicates that an independent vector set of an acoustic modal space generated by the secondary acoustic source array is determined by an azimuth angle $\phi_s$ and an elevation angle $\theta_s$ of the secondary acoustic source array; characteristics of the sound field generated by the secondary acoustic source array are determined by a radius $r_s$ of the secondary acoustic source array, and are reflected in low-pass characteristics of a function $j_n(kr_s)$ of a diagonal matrix J with respect to order n; matrix T is not a square matrix; the real-time control signal of the secondary acoustic source array is calculated by regularization.

(S4) On-Line Sound Field Adjustment Based on an Adaptive Method

The adaptive method is employed to realize the online sound field adjustment, which can overcome the adverse effects of the rotation speed fluctuation or flight states to realize the global noise reduction of the rotor under different flight states.

Ideally, the rotor noise is stable, and the control signal of the secondary acoustic source array obtained based on equation (11) can make the secondary acoustic source array accurately reconstruct the reverse sound field of noise of the rotor, which can realize the global noise reduction of the rotor noise. However, in actual situations, the inevitable rotation speed fluctuation of the rotor will change the phase of noise of the rotor, which will seriously affect the acoustic cancellation effect. Therefore, to guarantee the global noise reduction effect in the actual work of the rotorcraft, it is necessary to use an adaptive control technology to perform real-time adjustment of the reconstructed sound field. In this example, the control signal of the secondary acoustic source array is employed to online adjust the optimal phase and based on the optimal phase search method to suppress the adverse effects of the rotor speed fluctuation on the noise reduction effect.

Figure 2:
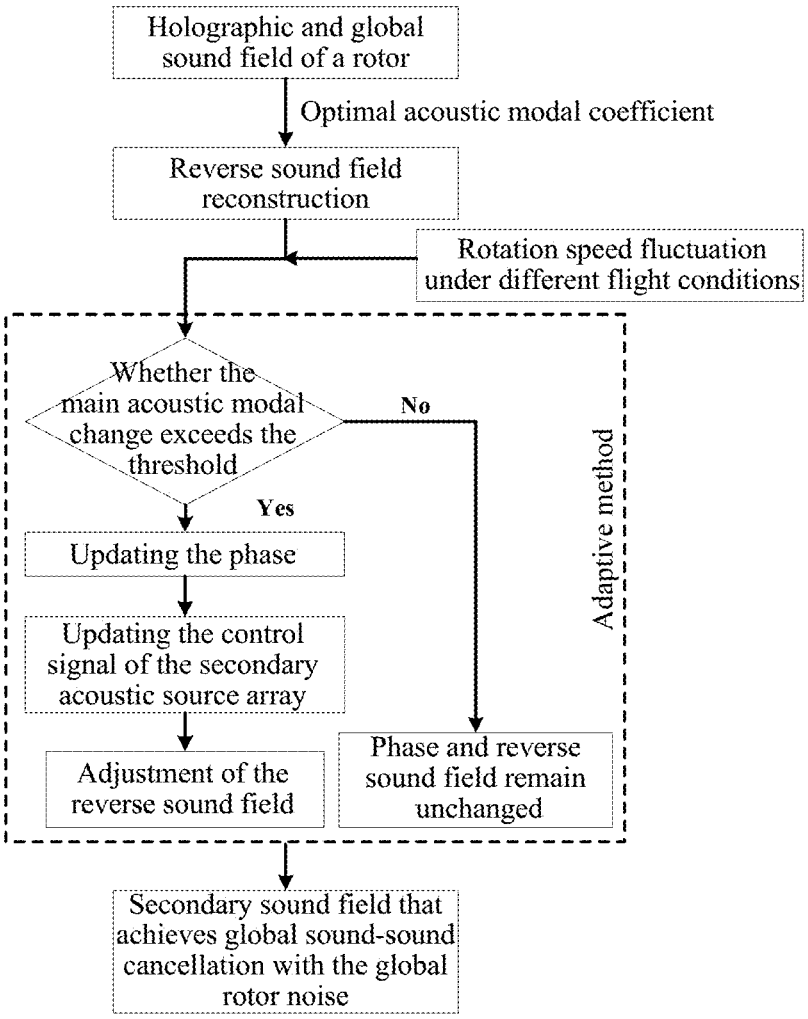
FIG. 2 is a flow chart of an adaptive online adjustment of a sound field according to an embodiment of the present disclosure.

As shown in FIG. 2, during reconstruction of a reverse sound field of the rotor, when a phase change caused by a speed fluctuation of the rotor exceeds a threshold, the adaptive method is used to update a phase and adjust the real-time control signal of the secondary acoustic source array online to realize adaptive reconstruction of the reverse sound field and further improve the practical value of the present disclosure.

The global noise reduction of the rotor based on acoustic holography and sound field reconstruction utilizes the constitutive relationship of the acoustic wave equation. On one hand, the complex noise control system with multiple inputs and outputs can be reduced to the optimal phase search, which greatly reduces the amount of calculation, facilitating to realize the online active control; on the other hand, it can wholly reduce the noise of the rotor, and realize the global noise reduction of the rotor noise.

The noise reduction simulation result of the rotor based on acoustic holography and acoustic reconstruction of the present disclosure shows that when the number of the secondary acoustic source array reaches eight, 22.70 dB noise suppression can be achieved at the measuring radius of the acoustic measuring device. As shown in FIGS. 3A-3D, based on the simulation results, the effect of global noise reduction on the spherical sound pressure distribution is illustrated, where FIG. 3A: original sound field of the rotor noise (r=0.7 m); FIG. 3B: sound field after the global noise control (r=0.7 m); FIG. 3C: original sound field of the rotor noise (r=1.4 m); and FIG. 3D: sound field after the global noise control (r=1.4 m). It can be seen from FIGS. 3A-3B that the in-plane noise is the largest, and the out-of-plane noise attenuates faster with the increase in radius than the in-plane noise. FIGS. 3B-3D shows that the method provided herein can achieve in-plane noise reduction while having a significant noise reduction effect on out-of-plane noise. The test results show that the method provided herein can achieve an overall 17.1 dB noise attenuation of the rotor noise, and meanwhile, the average noise attenuation of the secondary acoustic source array at 0.7 m is 15.8 dB, indicating that the rotor noise suppression method of the present disclosure has a good noise reduction effect.

In addition, an embodiment of the present disclosure also provides a computer-readable storage medium, which can store a program. The program is executed by a processor to implement any part or all steps of the global active noise control method described in the above embodiments.

In some embodiments, the functional units can be integrated into one processing unit, or independent, or two or more units may be integrated into one unit. The above-mentioned integrated unit can be implemented in the form of a hardware or a software functional unit.

If the integrated unit is implemented in the form of a software functional unit and sold or used as an independent product, it can be stored in a computer-readable memory. Based on this, the technical solutions of the present disclosure essentially or the part that contributes to the existing technology or all or part of the technical solutions can be embodied in the form of a software product, and the computer software product is stored in a memory, including a number of instructions to enable a computer device (or a personal computer, a server, or a network device, etc.) to perform all or part of the steps of the method described in each embodiment of the present disclosure. The aforementioned memory includes a U disk, a read-only memory (ROM), a random access memory (RAM), a mobile hard disk, a magnetic disk or an optical disk and other media that can store program codes.

It should be understood by those skilled in the art that all or part of the steps in the method of the above-mentioned embodiments can be implemented by relevant hardware instructed by a program. The program can be stored in a computer-readable memory, including a flash disk, a store media of a controller, a RAM, a magnetic disk, or an optical disc.

The above-mentioned embodiments are merely illustrative of the present disclosure, and are not intended to limit the disclosure. It should be noted that any modifications, changes and replacements made by those skilled in the art without departing from the spirit of the disclosure should fall within the scope of the disclosure defined by the appended claims.

What is claimed is:

1. A global active noise control method for a rotorcraft, comprising:

measuring, by an acoustic measuring device array arranged on the rotorcraft, noise of the rotorcraft;

inputting a noise pressure signal of the rotorcraft to acquire an acoustic mode expansion form of a global rotor noise by using an acoustic analysis method;

online estimating optimal acoustic modal coefficients based on acoustic holography by using a measurement signal of the acoustic measuring device array to obtain an acoustic holographic global sound field of a rotor;

based on the acoustic holographic global sound field, online generating a secondary sound field that achieves global sound-sound cancellation with the global rotor noise according to a sound field construction method by using a secondary acoustic source array;

inputting the optimal acoustic modal coefficients to online calculate a real-time control signal of the secondary acoustic source array according to an acoustic modal orthogonal relationship; and online adjusting the real-time control signal of the secondary acoustic source array by using an adaptive method to realize global noise reduction of the rotor under different flight conditions.

2. The global active noise control method of claim 1, wherein the acoustic mode expansion form of the global rotor noise is obtained through steps of:

for an aerodynamic noise of the rotor, a tip speed of which is less than speed of sound, setting a Ffowcs-Williams Hawking acoustic analogy equation as equation (1), wherein noise outside a rotor rotation area satisfies a passive homogeneous wave equation (2); and introducing a Fourier transform for derivation; shown as follows:

$$\nabla^2 p - \frac{1}{c^2}\frac{\partial^2 p}{\partial t^2} = -\frac{\partial}{\partial t}[\rho_0 v_n|\nabla f|\delta(f)] + \frac{\partial}{\partial x_i}[l_i|\nabla f|\delta(f)]; \quad (1)$$

and $$\nabla^2 p - \frac{1}{c^2}\frac{\partial^2 p}{\partial t^2} = 0; \quad (2)$$

wherein p is a sound pressure; c is the speed of sound; $v_n$ is a normal velocity of a blade surface; $\rho_0$ is air density; $l_i$ is a load per unit area of a medium; f(x,t)=0 is a boundary of the blade surface; δ(f) indicates that thickness and load noise sources are only distributed on the blade surface, and are surface sound sources; r,θ,ϕ respectively represent a distance from an observation point to an origin, an elevation angle, and an azimuth angle; ω is a noise frequency; and k□ω/c represents a wave number;

expressing an arrangement position of the acoustic measuring device array in a spherical coordinate system as equation (3), wherein a frequency domain form of an acoustic wave equation of the spherical coordinate system is expressed by equation (4); shown as follows:

$$r_j = (r_j, \theta_j, \phi_j), \quad (3)$$

$$j = 1 \cdots J;$$

and $$\nabla^2 p + k^2 p = 0. \quad (4)$$

based on a Fourier acoustic analysis method, a series expansion form of a solution of the global rotor noise that meets Sommerfeld radiation condition is expressed as equation (5):

$$p^d(r, \theta, \phi, k) = \sum_{n=0}^{\infty} h_n^{(1)}(kr) \sum_{m=-n}^{n} C_{m,n}(k) Y_n^m(\theta, \phi); \quad (5)$$

wherein $C_{m,n}(k)$ is an acoustic modal coefficient; $h_n^{(1)}(kr)$ represents a first-order Spherical Hankel function; and $Y_n^m(\theta,\phi)$ represents a spherical harmonics function.

3. The global active noise control method of claim 2, wherein the optimal acoustic modal coefficients are estimated online through steps of:

in a specified basis function $\Psi_{n,m}^{(1)}$, performing an optimal approximation on a noise pressure signal of a measuring point to estimate the optimal acoustic modal coefficients, wherein the acoustic modal coefficients and the noise pressure signal of the measuring point of the acoustic measuring device array meet the following equations:

$$\{p^d(r_j, \theta_j, \phi_j, k)\}_{J\times 1} = \left[\Psi^{(1)}(r_j, \theta_j, \phi_j, k)\right]_{J\times\{(N'+1)^2\}} \{C_{m,n}(k)\}_{\{(N'+1)^2\}\times 1}; \quad (6)$$

and

-continued $$\Psi_{n,m}^{(1)}(r_j, \theta_j, \phi_j, k) \equiv h_n^{(1)}(kr_j) Y_n^m(\theta_j, \phi_j); \quad (7)$$

and solving the optimal acoustic modal coefficients by using a regularization method, expressed as:

$$\{C_{m,n}(k)\} = \left(\left[\Psi^{(1)}\right]^H \left[\Psi^{(1)}\right]\right)^{-1} \left[\Psi^{(1)}\right]^H \{p^d\}. \quad (8)$$

4. The global active noise control method of claim 3, wherein the secondary sound field is generated online through steps of:

expressing an arrangement position of the secondary acoustic source array in the spherical coordinate system as $r_s=(r_s,\theta_s,\phi_s)$, s=1 . . . S, wherein a sound field generated by the secondary acoustic source array is expressed as equation (9); and a reconstructed target sound field meets equation (10); shown as follows:

$$p^S(r, \theta, \phi, k) = \sum_{s=1}^{S} p^s(r, \theta, \phi, k) \ |r| \geq \max_{1\leq s\leq S}|r_s| = \sum_{n=0}^{\infty} h_n^{(1)}(kr) \sum_{m=-n}^{n} ik\left(\sum_{s=1}^{S} Q_s j_n(kr_s) Y_n^m(\theta_s, \phi_s)^*\right) Y_n^m(\theta, \phi); \quad (9)$$

and $$p^S(r, \theta, \phi, k) = -p^d(r, \theta, \phi, k) = \sum_{n=0}^{\infty} h_n^{(1)}(kr) \sum_{m=-n}^{n} -C_{m,n}(k) Y_n^m(\theta, \phi); \quad (10)$$

wherein $Q_s$ is a mass-source intensity of a secondary acoustic source, and $Q_s=-i\omega\rho_0 q_s$; and $q_s$ is a volume-source intensity of the secondary acoustic source.

5. The global active noise control method of claim 4, wherein the real-time control signal of the secondary acoustic source array is calculated online through steps of:

according to equation (9) and equation (10) and based on an orthogonality of the acoustic modal coefficients, adjusting the real-time control signal of the secondary acoustic source array until a source intensity meets equation (11) to generate a reverse sound field of the global rotor noise, wherein matrix parameters in the equation (11) are expressed by equations (12)-(15):

$$ikJTQ = -C; \quad (11)$$

$$Q = [\,Q_1 \ \cdots \ Q_S\,]^T_{S\times 1}; \quad (12)$$

$$T = \{Y_n^m(\theta_s, \phi_s)^*\}_{(N'+1)^2\times S}; \quad (13)$$

$$J = \{j_n(kr_s)\}_{(N'+1)^2\times(N'+1)^2}; \quad (14)$$

and $$C = \{C_{m,n}(k)\}_{(N'+1)^2\times 1}; \quad (15)$$

wherein matrix Q represents a sound source intensity of each unit of the secondary acoustic source array; matrix T indicates that an independent vector set of an acoustic modal space generated by the secondary acoustic source array is determined by an azimuth angle $\phi_s$ and an elevation angle $\theta_s$ of the secondary acoustic source array;

characteristics of the secondary sound field generated by the secondary acoustic source array are determined by a radius $r_s$ of the secondary acoustic source array, and are reflected in low-pass characteristics of a function $j_n(kr_s)$ of a diagonal matrix J with respect to order n; matrix T is not a square matrix; the real-time control signal of the secondary acoustic source array is calculated by regularization.

6. The global active noise control method of claim 1, wherein the sound field construction method is a high-order ambient stereo method, a wave field synthesis method, a spherical harmonic decomposition method, or a combination thereof.

7. The global active noise control method of claim 1, wherein the adaptive method is an exponential phase online search method.

8. The global active noise control method of claim 5, wherein during reconstruction of the reverse sound field of the rotor, when a phase change caused by a speed fluctuation or flight condition of the rotor exceeds a threshold, the adaptive method is used to update a phase and adjust the real-time control signal of the secondary acoustic source array online to realize adaptive reconstruction of the reverse sound field.

9. The global active noise control method of claim 1, wherein the acoustic measuring device array and the secondary acoustic source array are arranged in the rotorcraft; the acoustic measuring device array is configured to collect a noise pressure signal data at a measuring point; and the secondary acoustic source array is configured to online generate the secondary sound field that offsets the global noise of the rotor.

10. A non-transitory computer-readable storage medium, wherein the computer-readable storage medium is configured to store a computer program; and the computer program is configured to be executed by a processor to implement the global active noise control method of claim 1.

* * * * *